US005669574A

United States Patent [19]

Calhoun

[11] Patent Number: 5,669,574

[45] Date of Patent: Sep. 23, 1997

[54] STORABLE CARPET RUNNER

[76] Inventor: Deborah A. Calhoun, 66 Elizabeth Ave., Hempstead, N.Y. 11550

[21] Appl. No.: 594,227

[22] Filed: Jan. 31, 1996

[51] Int. Cl.[6] ..... B65H 75/40

[52] U.S. Cl. ..... 242/395; 242/398; 242/406; 242/588.6; 242/919; 428/85

[58] Field of Search ..... 242/395, 395.1, 242/398, 406, 588.6, 596.8, 598.6, 919, 379; 296/98, 156, 163; 428/85, 88

[56] References Cited

U.S. PATENT DOCUMENTS

| | | | |
|---|---|---|---|
| 527,644 | 10/1894 | Akers | 242/588.6 |
| 1,470,886 | 10/1923 | Sherwin | 242/404.3 |
| 1,569,577 | 1/1926 | Robinson | 242/598.6 |
| 3,283,886 | 11/1966 | Addis et al. | 242/588.6 |
| 3,664,594 | 5/1972 | Novak | 242/395.1 |
| 4,195,875 | 4/1980 | Venne | 242/919 |
| 4,991,789 | 2/1991 | Buerger | 242/919 |

FOREIGN PATENT DOCUMENTS

| | | | |
|---|---|---|---|
| 4-2531 | 1/1992 | Japan | 428/85 |

*Primary Examiner*—John M. Jillions

[57] ABSTRACT

A carpet runner for positioning upon a floor and for permitting rolled storage of the carpet during periods of non-use thereof. The inventive device includes a housing having a slot extending through a front wall thereof. An elongated length of carpet extends through the slot and can be stored upon a spool rotatably mounted within the housing. A crank mounted within a recess in the side wall of the housing permits for manual rolling of the carpet into the housing and onto the spool for storage. Removable indicia plates can be mounted to the length of carpet for permitting customizing of the invention to a particular occasion.

4 Claims, 3 Drawing Sheets

STORABLE CARPET RUNNER

BACKGROUND OF THE INVENTION

1. Field of the Invention

The present invention relates to carpet structures and more particularly pertains to a storable carpet runner for positioning upon a floor and for permitting rolled storage of the carpet during periods of non-use thereof.

2. Description of the Prior Art

The use of carpet structures is known in the prior art. More specifically, carpet structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art carpet structures include U.S. Pat. Nos. 3,617,082; 4,008,879; 4,042,211; 5,145,225; 5,183,238; 5,228,660; 5,255,894.

While these devices fulfill their respective, particular objectives and requirements, the aforementioned patents do not disclose a storable carpet runner for positioning upon a floor and for permitting rolled storage during periods of non-use thereof which includes a housing having a slot extending through a front wall thereof, an elongated length of carpet extending through the slot, a spool rotatably mounted within the housing upon which the carpet can be stored, a crank mounted within a recess in the side wall of the housing, and removable indicia plates mounted to the length of carpet for permitting customizing of the invention to a particular occasion.

In these respects, the storable carpet runner according to the present invention substantially departs from the conventional concepts and designs of the prior art, and in so doing provides an apparatus primarily developed for the purpose of positioning upon a floor and for permitting rolled storage of the carpet during periods of non-use thereof.

SUMMARY OF THE INVENTION

In view of the foregoing disadvantages inherent in the known types of carpet structures now present in the prior art, the present invention provides a new storable carpet runner construction wherein the same can be utilized for positioning upon a floor and for permitting rolled storage of the carpet during periods of non-use thereof. As such, the general purpose of the present invention, which will be described subsequently in greater detail, is to provide a new storable carpet runner apparatus and method which has many of the advantages of the carpet structures mentioned heretofore and many novel features that result in a storable carpet runner which is not anticipated, rendered obvious, suggested, or even implied by any of the prior art carpet structures, either alone or in any combination thereof.

To attain this, the present invention generally comprises a carpet runner for positioning upon a floor and for permitting rolled storage during periods of non-use thereof. The inventive device includes a housing having a slot extending through a front wall thereof. An elongated length of carpet extends through the slot and can be stored upon a spool rotatably mounted within the housing. A crank mounted within a recess in the side wall of the housing permits for manual rolling of the carpet into the housing and onto the spool for storage. Removable indicia plates can be mounted to the length of carpet for permitting customizing of the invention to a particular occasion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new storable carpet runner apparatus and method which has many of the advantages of the carpet structures mentioned heretofore and many novel features that result in a storable carpet runner which is not anticipated, rendered obvious, suggested, or even implied by any of the prior art carpet structures, either alone or in any combination thereof.

It is another object of the present invention to provide a new storable carpet runner which may be easily and efficiently manufactured and marketed.

It is a further object of the present invention to provide a new storable carpet runner which is of a durable and reliable construction.

An even further object of the present invention is to provide a new storable carpet runner which is susceptible of a low cost of manufacture with regard to both materials and labor, and which accordingly is then susceptible of low prices of sale to the consuming public, thereby making such storable carpet runners economically available to the buying public.

Still yet another object of the present invention is to provide a new storable carpet runner which provides in the apparatuses and methods of the prior art some of the advantages thereof, while simultaneously overcoming some of the disadvantages normally associated therewith.

Still another object of the present invention is to provide a new storable carpet runner for positioning upon a floor and for permitting rolled storage of the carpet during periods of non-use thereof.

Yet another object of the present invention is to provide a new storable carpet runner which includes a housing having a slot extending through a front wall thereof, an elongated length of carpet extending through the slot, a spool rotatably mounted within the housing upon which the carpet can be stored, a crank mounted within a recess in the side wall of the housing, and removable indicia plates mounted to the length of carpet for permitting customizing of the invention to a particular occasion.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
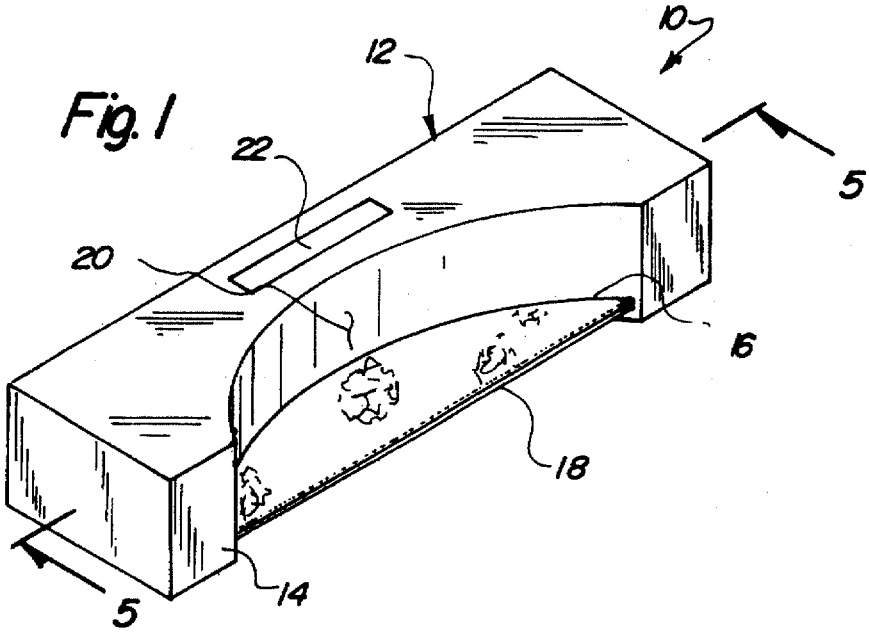
FIG. 1 is an isometric illustration of a storable carpet runner according to the present invention.

With reference now to the drawings, and in particular to FIGS. 1–6 thereof, a new storable carpet runner embodying the principles and concepts of the present invention and generally designated by the reference numeral 10 will be described.

More specifically, it will be noted that the storable carpet runner 10 comprises a housing 12 including a front wall 14 having a slot 16 directed therethrough, as shown in FIG. 1. A length of carpet 18 includes substantially spaced and parallel longitudinal side edges and is received through the slot 16 through the front wall 14 of the housing 12 for storage therein. By this structure, the length of carpet 18 can be selectively extended from the housing 12 for placement on a floor surface such as during a wedding ceremony or like occasion. Subsequent to use, the length of carpet 18 can then be manually positioned back into the housing 12 for storage during periods of non-use thereof.

Figure 2:
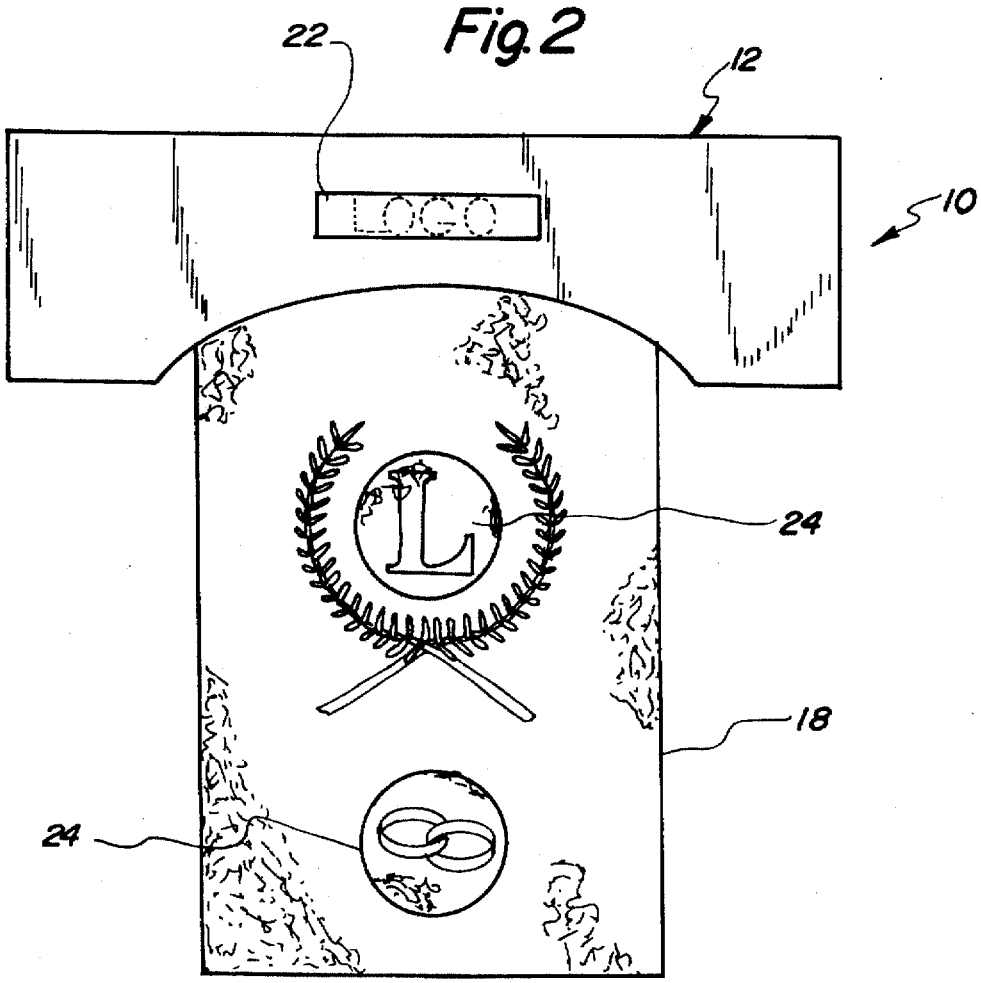
FIG. 2 is a top plan view of the invention.

Referring now to FIGS. 1 and 2 in detail, it can be shown that the housing is preferably shaped so as to define a front wall recess 20 directed into the front wall thereof which allows an individual to grasp the length of carpet 18 by both hands during the initial extension of the carpet from the housing. If desired, an indicia plate 22 can be affixed to a top surface of the housing 12 for ornamental and identificational purposes.

Figure 4:
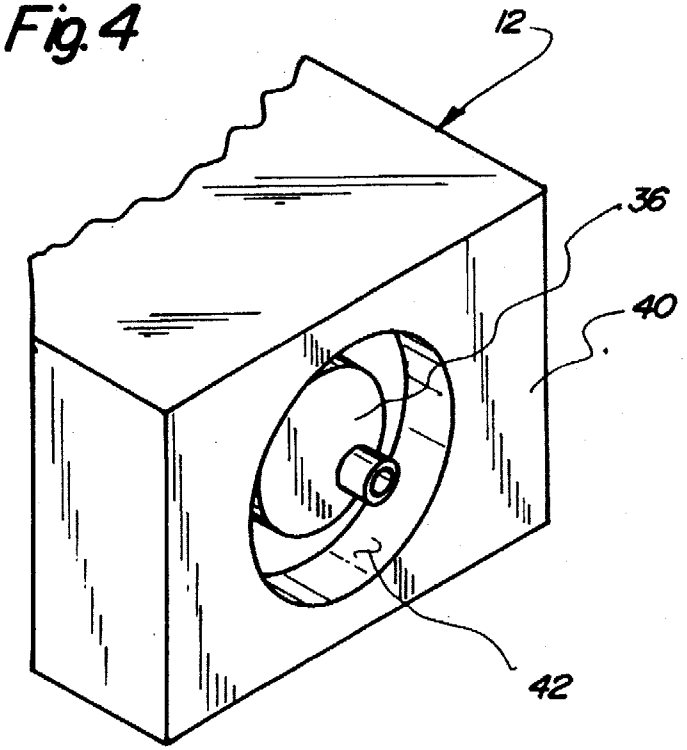
FIG. 4 is an exploded isometric illustration of a further portion of the invention.
Figure 3:
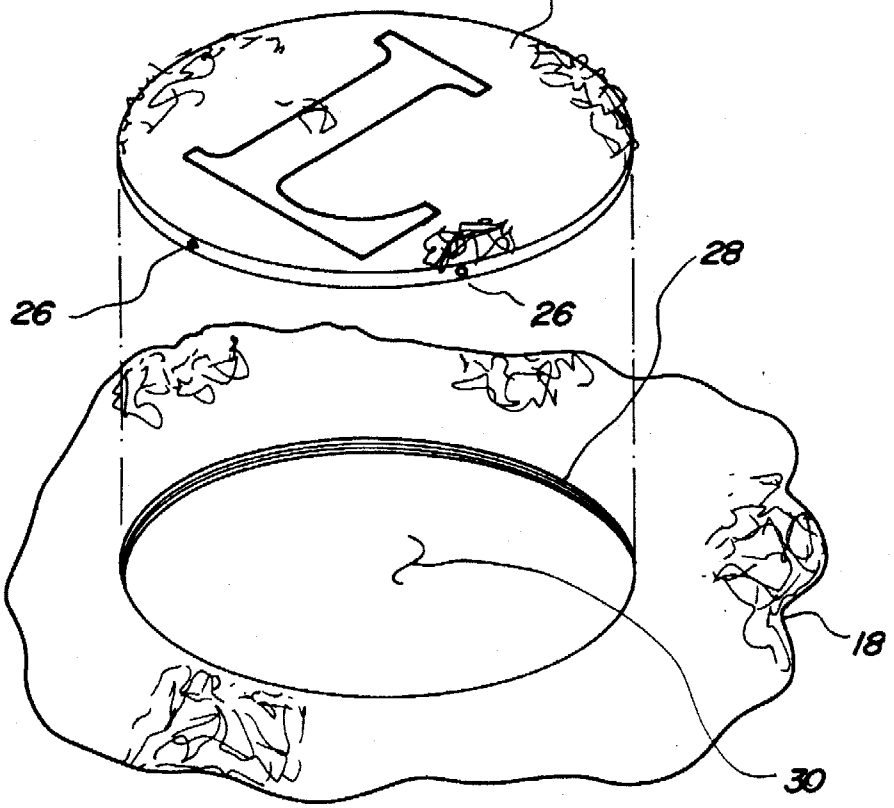
FIG. 3 is an isometric illustration of a portion of the invention.

As shown in FIGS. 2 and 4, the length of carpet 18 may include carpet indicia members 24 removably coupled thereto for ornamental and identificational purposes. To this end, the carpet indicia members 24 each include a plurality of securing projections 26 extending from an outer edge or edges thereof which are received within a receiving groove 28 directed into the length of carpet 18. More specifically, the length of carpet 18 is preferably shaped so as to define a receiving aperture 30 directed thereinto or therethrough, with the receiving groove 28 being directed into the backing of the length of carpet 18. The carpet indicia member 24 can then be positioned into the receiving aperture 30, whereby the securing projections can then be positioned into the receiving groove 28 to secure the carpet indicia member 24 within the receiving aperture. By this structure, interchangeable positioning of a desired carpet indicia member 24 can be accomplished relative to the length of carpet 18.

Figure 5:
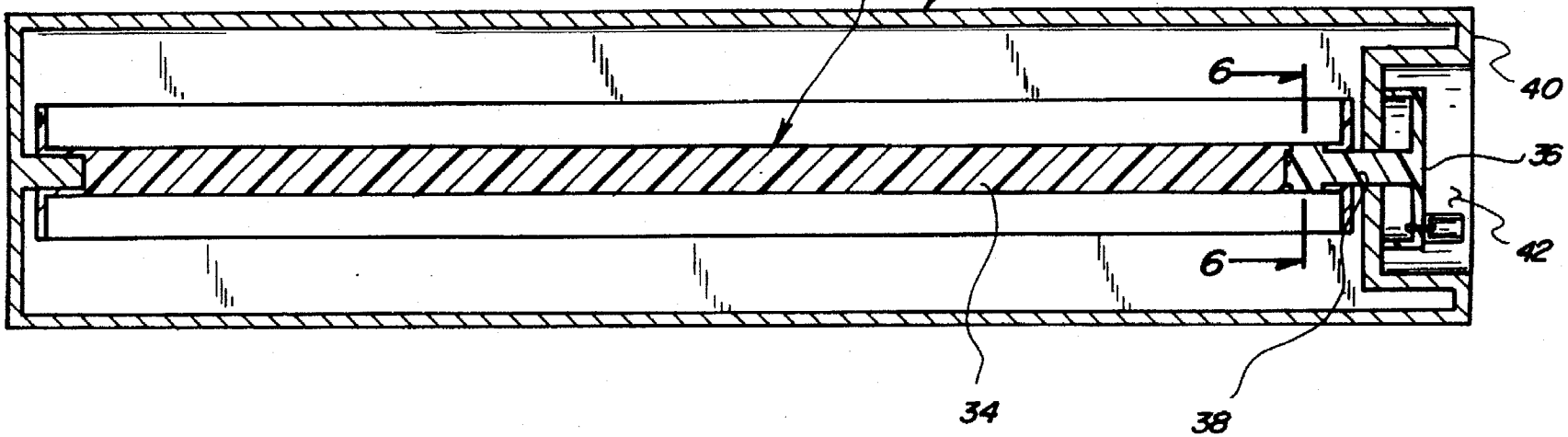
FIG. 5 is a cross sectional view taken along line 5—5 of FIG. 1.
Figure 6:
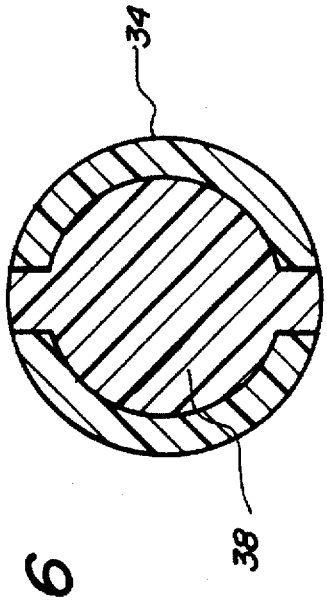
FIG. 6 is a cross sectional view taken along line 6—6 of FIG. 5.

Referring now to FIGS. 4 through 6, it can be shown that the present invention 10 further comprises a spool 32 rotatably mounted within the housing 12 upon which the length of carpet is wound during storage thereof within the housing. To this end, a center axle 34 of the spool is rotatably mounted across an interior of the housing 12, with a crank 36 including a crank axle 38 directed through a side wall 40 of the housing and being coupled to an end of the center axle 34 as shown in FIG. 6 for example. Preferably, the crank 36 is mounted within a cylindrical side wall recess 42 directed into the side wall 40 of the housing such that the crank 36 is recessed to be hidden from view.

In use, the storable carpet runner 10 of the present invention can be easily extended from the housing for positioning upon a ground surface. After use of the length of carpet 18 in a ceremony or other occasion, the length of carpet 18 can be wound back into the housing and onto the spool 32.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A storable carpet runner comprising:

a housing including a front wall having a slot directed therethrough;

a length of carpet received through the slot through the front wall of the housing for storage therein wherein the housing is shaped so as to define a front wall recess directed into the front wall thereof which allows an individual to grasp the length of the carpet by both hands during initial extension of the length of carpet from the housing;

wherein the length of carpet includes at least one carpet indicia member removably coupled thereto;

wherein the length of carpet is shaded so as to define a receiving groove directed thereinto; and further wherein the carpet indicia member includes at least one securing projection extending from an outer edge thereof which is received within the receiving groove of the length of carpet;

wherein the length of carpet is shaded so as to define a receiving aperture directed thereinto, with the receiving groove being directed into a backing portion of the length of carpet, whereby the carpet indicia member is positioned into the receiving aperture, with the securing projection being positioned into the receiving groove to secure the carpet indicia member within the receiving aperture.

2. The storable carpet runner of claim 1, and further comprising a spool rotatably mounted within the housing upon which the length of carpet is at least partially wound.

3. The storable carpet runner of claim 2, wherein the spool includes a center axle rotatably mounted across an interior of the housing; and further comprising a crank including a crank axle directed through a side wall of the housing and being coupled to an end of the center axle.

4. The storable carpet runner of claim 3, wherein the housing is shaped so as to define a cylindrical side wall recess directed into the side wall of the housing, with the crank being mounted within the cylindrical side wall recess such that the crank is recessed and hidden from view from a front of the housing.

* * * * *